United States Patent [19]

Flander et al.

[11] 4,389,764

[45] Jun. 28, 1983

[54] METHOD FOR THE PRODUCTION AND ASSEMBLY OF LOCK PARTS

[75] Inventors: Walter Flander, Helsinki; Jukka Leikas; Vesa Hirvonen, both of Joensuu, all of Finland

[73] Assignee: Oy Wartsila Oy, Helsinki, Finland

[21] Appl. No.: 248,296

[22] Filed: Mar. 27, 1981

[30] Foreign Application Priority Data

Apr. 1, 1980 [FI] Finland ..... 801037

[51] Int. Cl.[3] ..... B23P 17/00

[52] U.S. Cl. ..... 29/416; 29/411; 29/412

[58] Field of Search ..... 29/411, 416, 412, 405, 29/863, 564.6; 70/362, 366; 234/116, 101, 105, 106, 112, 117

[56] References Cited

U.S. PATENT DOCUMENTS 2,565,599 5/1948 Elliott ..... 29/863
2,659,406 11/1953 Locke ..... 29/564.6
3,037,689 6/1959 Flavin et al. ..... 234/106
3,334,809 8/1967 Zajic et al. ..... 234/106
4,320,640 3/1982 Martikainen ..... 70/366

FOREIGN PATENT DOCUMENTS 158286 2/1921 United Kingdom .

*Primary Examiner*—Ervin M. Combs
*Assistant Examiner*—Steven Nichols
*Attorney, Agent, or Firm*—McAulay, Fields, Fisher, Goldstein & Nissen

[57] ABSTRACT

A method for punching disc-like lock parts from a metal band or the like and for combining them to form lock mechanism units determining different lock combinations or the like. The punching of the parts to their final form takes place in a series of punching actions carried out by different punching units. Punching of parts having different details is carried out by having the pattern of the series changed for each punching stroke. In a final phase, the punched lock parts are separated from the band and collected in an order determined by a pre-selected combination code.

14 Claims, 4 Drawing Figures

METHOD FOR THE PRODUCTION AND ASSEMBLY OF LOCK PARTS

BACKGROUND OF THE INVENTION

The invention relates to a method for punching disc-like parts from a sheet band or the like and for combining them to form lock mechanism units determining different lock combinations.

The production of disc-like lock parts of the kind the invention relates to, for example, the production of tumbler discs for rotary disc tumbler cylinder locks, which in the following is described by way of example, is conventionally performed so, that for all the different discs there is a separate punch tool capable of punching one specific kind of a disc only. The tumbler discs differ from each other because each disc has its own specific lock combination value determined by the position of a peripheral notch in the disc. In addition, there may be shallow, so called false notches, and also the central opening for the key may have a different form in some discs. The discs are inserted into a hollow lock cylinder, and this is conventionally carried out by picking a disc of each type separately, according to a given lock combination, from a stock of different discs already produced and by inserting a separate spacer disc between adjacent tumbler discs. A cylinder lock mechanism of this kind is described in British Pat. No. 158 286.

The conventional production of locks of the kind referred to requires either the use of several separate punching machines and/or the production of parts in a successive order, which requires frequent tool changes. The number of different tumbler disc types may be considerable. Thus, quite an extensive intermediate storing is necessary, which ties up capital and requires a continuous supervision. The final assembly of the lock parts is slow and cumbersome.

The object of the invention is to considerably improve the production and assembly of said disc-like lock parts. By means of the invention, the production and assembly of said lock parts can be integrated, so that no intermediate storing of discs is necessary. Since the production of the parts is carried out by means of several successive punching operations, the production can be arranged in one process line, so that any lock code change is possible without changing tools, which essentially speeds up the production and makes the whole system very flexible.

According to the invention, the punching units carrying out different punching operations are successively arranged along a production line, which supplies and transfers a metal band or the like, so that there is, simultaneously, in each punching unit a lock part blank, which is moved from one punching unit to another as a portion of the metal band. The punching units are preferably combined to form a larger punching machine provided with one common element activating all the punching tools. The punching of arbitrarily selected combinations is preferably carried out so, that at least some of the punching units are kept inactive, independently from other units, whereby punching is carried out only by those units that are needed for producing the desired pattern. The system is so governed, that the punching combinations carried out may be different in every successive punching action. The punching machine may comprise, for example, hydraulic or pneumatic power transmission members, which preferably by means of electrically activated valves are moved, according to a selected lock combination code, either into a punching tool activating or into a punching tool blocking position. Thereby, each punching tool is individually controllable.

The described production of lock parts can favourably be applied to the production of tumbler discs for a rotary disc tumbler cylinder lock. The tumbler discs can also after their detachment from the metal band be kept in the same order, for example by putting them back into their places in the band, to move along with the band. The production and supply of spacer discs is preferably operationally combined with the movements of the tumbler disc band, so that spacer discs are automatically inserted between the tumbler discs. Thereby, a complete disc pile for a lock mechanism is directly assembled during the production. The final detaching punching of a discs can also be carried out so, that the band portion outside the discs is removed. Then means are required for further guiding of the discs. The lock combination code controlling the production of tumbler discs and their assembly into a lock mechanism disc pile can be simultaneously or separately used for the production of corresponding keys. The production of keys and lock mechanism can be combined, so that each lock mechanism is automatically provided with a desired number of corresponding keys.

BRIEF DESCRIPTION OF THE DRAWINGS

In the following, the invention is described more in detail, with reference to the attached drawing, in which FIG. 1 schematically shows different phases of the method according to the invention.

DESCRIPTION OF THE PREFERRED EMBODIMENT

Figure 1:
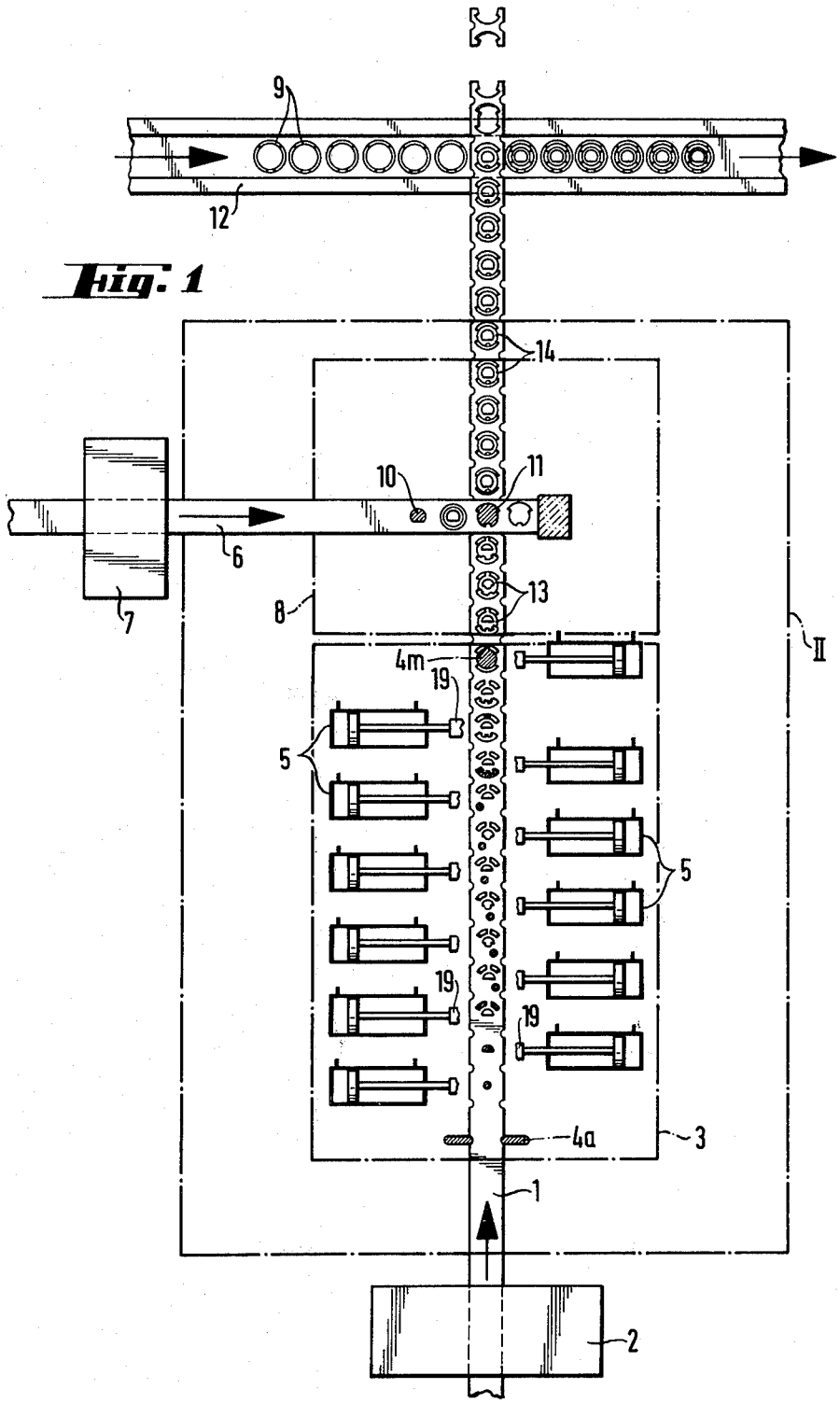

In the drawing, reference numeral 1 refers to a metal band, from which different tumbler discs 13 are produced by punching. Band 1 is fed by a supply device 2 into a punching machine 3 comprising several punching units, not shown in detail. The punching is synchronized with the movements of metal band 1. Each punching unit carries out a different kind of punching. The punching units are generally indicated by reference numeral 4 (FIGS. 3 and 4), specifically by reference numerals 4*a* . . . 4*m*.

Simultaneously with the punching of tumbler discs 13, the punching of spacer discs 14 is carried out from another metal band 6 supplied from a supply unit 7. The assembly of spacer discs and tumbler discs 13 to complete lock mechanism disc piles is carried out either directly into lock cylinders 9 or into storage cassettes supplied along a track 12.

Figure 2:
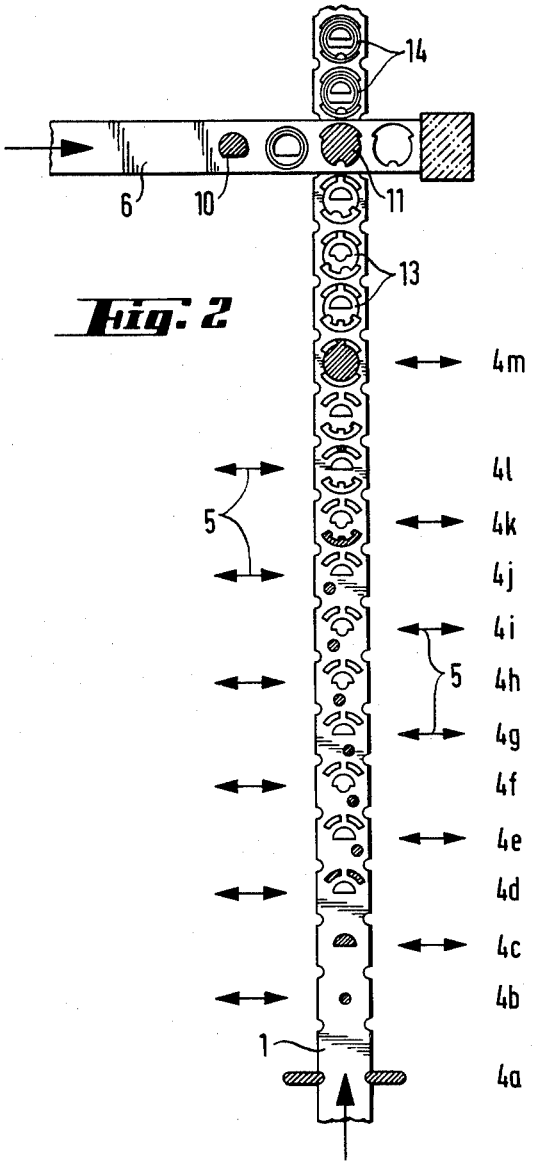
FIG. 2 shows more in detail portion II of FIG. 1.

FIG. 2 shows the production of tumbler discs 13 and spacer discs 14. As shown in FIG. 2, punching of tumbler discs 13 into their final, code-carrying form is performed by moving tumbler disc blanks included in band 1 through phases 4*a* . . . 4*m*. Each of these phases corresponds to an action of one punching unit. Thus, each punching unit, independently from the other units, attends one tumbler disc at a time. Punching units performing certain alternative details operate in a either-or mode, that is, the unit is either activated or is not activated. For this purpose the units are provided with setting means 5 comprising, for example, a hydraulically or pneumatically operated power transmission member 19 (FIGS. 3 and 4), which is controlled by means of an electrically operated valve. By this means the punching operations, governed by a lock combination code input, can be carried out in arbitrarily selectable consecutive combinations, if required, differently in every punching action.

Figure 3:
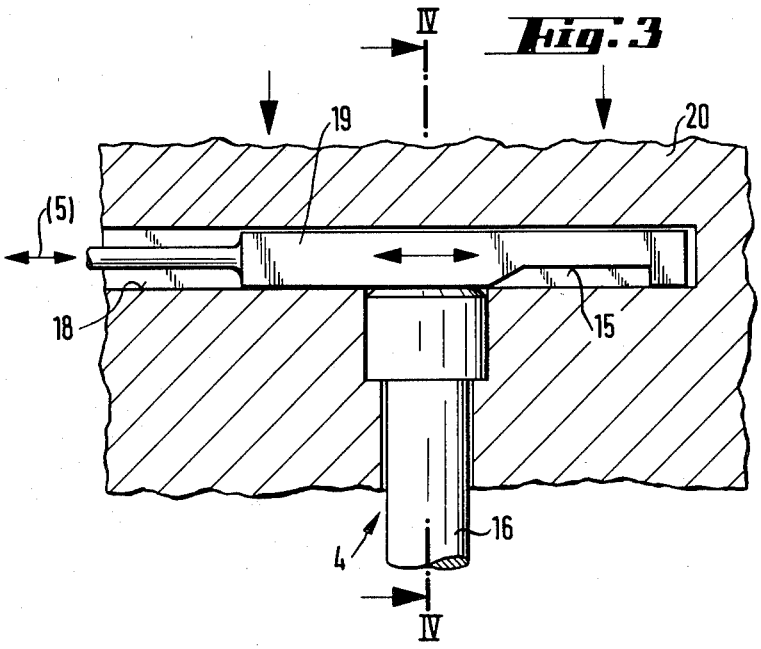
FIG. 3 shows a practical arrangement for some phases of the method.
Figure 4:
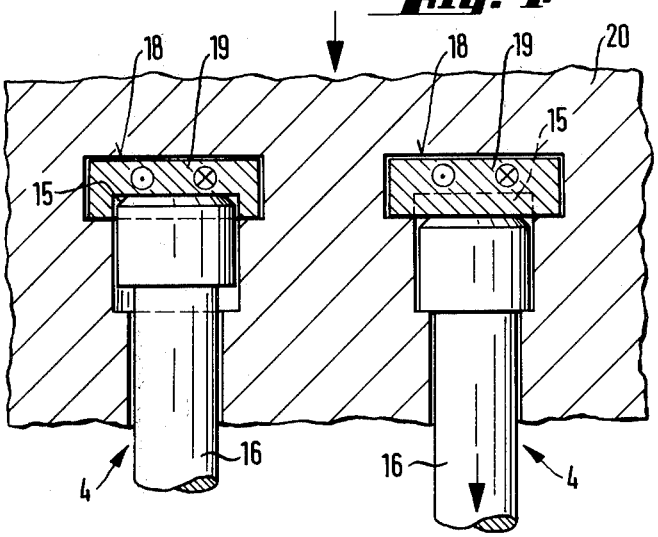
FIG. 4 shows section IV—IV of FIG. 3.

In FIGS. 3 and 4, the action of power transmission member 19 is shown more in detail. Punching machine 3 has a movable body 20 including punching tools 16 for each punching unit. By moving body 20 the tools 16 are pressed against a punch die (not shown) and punching is performed. In movable body 20 there is, for each tool 16, a power transmission member 19 movable in a duct 18. Power transmission member 19 is provided with a recess 15 for inactivating tool 16. No punching action is carried out by a tool of which the upper end portion is free to move into such a recess 15 when body 20 makes its punching movement (FIG. 4, left). If power transmission member 19 has the position shown in FIG. 3 and to the right in FIG. 4, power will be transmitted from body 20 to punching tool 16 and punching is carried out. Inactivating of a tool can, of course, also be arranged in many other manners known per se.

In the embodiment shown in FIG. 2, each tumbler disc of band 1 proceeds through the following working phases:

4*a:* auxiliary band edge punching for exact band location and tallying (compulsory operation),

4*b:* punching of an enlargement forming part of the central opening for the key, (optional operation),

4*c:* punching of main part of the central opening for the key (compulsory),

4*d:* formation of edge protrusion (compulsory),

4*e* . . . 4*j:* punching of a peripheral notch at a location determined by the selected lock combination (compulsory in one phase),

4*k:* punching of so called false notches (optional),

4*l:* removal of edge protrusion formed in phase 4*d* (optional),

4*m:* detachment of tumbler disc from band 1 (compulsory).

Although the tumbler discs 13 are detached in phase 4*m*, they are put back in their original place in band 1, for further transport together with band 1 to position 11, where spacer discs 14 are detached from band 6 and placed over every tumbler disc 13 in band 1. Only the last tumbler disc of a disc pile does not receive any spacer disc. In phase 10, band 6 is provided with the central opening typical for the spacer discs. A wave-formed deformation, concentric with the opening, is made in the next phase for giving the spacer discs a certain axial flexibility.

As shown in FIG. 1, tumbler discs 13 and spacer discs 14 are collected in track or line 12 to form complete disc piles having a variable number of locking discs, usually 6 . . . 11.

A microprocessor (not shown) can favourably be used for governing the whole production of the discs and their collection to complete lock mechanism piles, in accordance with varying inputs, determining desired lock combinations. The production of corresponding keys can be governed by the same processor as the disc production.

The invention is not limited to the embodiment shown, but several modifications thereof are feasible within the scope of the attached claims.

We claim:

1. A method for punching disc-like lock parts from a sheet band or the like and for combining them to form lock mechanism units determining different lock combinations, including the steps of:

arranging the punching of said parts to their final form in a series of punching actions carried out by a plurality of punching units;

punching of said parts with different details by having the pattern of said series changeable for each punching stroke; and that in a final phase of said punching, separating said disc-like lock parts from said band and collecting said parts in an order determined by a pre-selected combination code.

2. A method according to claim 1, in which said punching units are arranged one after another in a line along said band, and are arranged to act simultaneously, so that there is, at the same time, in each punching unit, a lock part blank, which moves from one punching unit to another together with said band.

3. A method according to claim 2, in which said punching units are combined in a punching machine provided with a common movable element for all punching tools for giving them a punching stroke.

4. A method according to claim 3, in which at least some of said punching units have punching tools, each said punching tool having an active state and an inactive state, which, independently from other units, are placed into the active state or kept in the inactive state, and that the actions of said tools are so governed, that punching combinations carried out by said punching units may be chosen differently in every successive punching stroke.

5. A method according to claim 4, in which said units comprise a hydraulically or pneumatically operable power transmission member, and that said power transmission member is moved according to a pre-selected input code so as to either activate or inactivate said punching tools.

6. A method according to claim 5, in which the operation of said power transmission member is carried out by means of electrically operable valves.

7. A method for punching disc-like lock parts from a sheet band or the like and for combining them to form lock mechanism units determining different lock combinations, including the steps of:

arranging the punching of said parts to their final form in a series of punching actions carried out by a plurality of punching units, whereby the punching of the parts having different details is carried out by having the pattern of said series changeable for each punching stroke;

separating said disc-like lock parts from said band and collecting them in a final phase of said punching in an order determined by a pre-selected combination code; and detaching different tumbler discs from said band, that thereafter their mutual order is kept unchanged, and that production and supply of spacer discs is operationally combined with the production of said tumbler discs, so that a spacer disc is automatically inserted between adjacent tumbler discs in every lock mechanism disc pile.

8. A method according to claim 7, in which, upon detaching of tumbler discs from their band they are put back in their former place in said band for further transport together with said band.

9. A method according to claim 7, in which said punching units are arranged one after another in a line along said band, and are arranged to act simultaneously, so that there is, at the same time, in each punching unit, a lock part blank, which moves from one punching unit to another together with said band.

10. A method according to claim 9, in which said punching units are combined in a punching machine provided with a common movable element for all punching tools for giving them a punching stroke.

11. A method according to claim 10, in which at least some of said punching units have punching tools, which, independently from other units have a first active state and a second inactive state, and that the active state and inactive state of said tools are so governed, that punching combinations carried out by said punching units may be chosen differently in every successive punching stroke.

12. A method according to claim 11, in which said units comprise a hydraulically or pneumatically operable power transmission member, and that said power transmission member is moved according to a preselected input code so as to either activate or inactivate said punching tools.

13. A method according to claim 12, in which the operation of said power transmission member is carried out by means of electrically operable valves.

14. A method according to claim 1, in which at least some of said punching units have punching tools, each said punching tool having an active state and an inactive state, which, independently from other units, are placed into one of said states, and that the actions of said tools are so governed, that punching combinations carried out by said punching units may be chosen differently in every successive punching stroke.

* * * * *